US009331396B2

(12) United States Patent
Tran et al.

(10) Patent No.: US 9,331,396 B2
(45) Date of Patent: May 3, 2016

(54) ANTENNA STRUCTURE HAVING ORTHOGONAL POLARIZATIONS

(71) Applicant: QUALCOMM Incorporated, San Diego, CA (US)

(72) Inventors: Allen Minh-Triet Tran, San Diego, CA (US); Donald Farrell Breslin, Sunnyvale, CA (US); Xiaohua Yang, Sunnyvale, CA (US)

(73) Assignee: QUALCOMM Incorporated, San Diego, CA (US)

( * ) Notice: Subject to any disclaimer, the term of this patent is extended or adjusted under 35 U.S.C. 154(b) by 333 days.

(21) Appl. No.: 13/947,980

(22) Filed: Jul. 22, 2013

(65) Prior Publication Data

US 2014/0327588 A1 Nov. 6, 2014

Related U.S. Application Data

(60) Provisional application No. 61/820,073, filed on May 6, 2013.

(51) Int. Cl.
*H01Q 21/24* (2006.01)

(52) U.S. Cl.
CPC ..... *H01Q 21/24* (2013.01)

(58) Field of Classification Search
CPC ..... H01Q 21/24
USPC ..... 343/727, 876, 893, 700 MS, 702, 725
See application file for complete search history.

(56) References Cited

U.S. PATENT DOCUMENTS

| | | | | |
|---|---|---|---|---|
| 7,724,201 | B2 | 5/2010 | Nysen et al. | |
| 8,059,046 | B2 | 11/2011 | Nysen | |
| 8,068,068 | B2 * | 11/2011 | Kish et al. | 343/876 |
| 8,326,249 | B2 | 12/2012 | Cezanne et al. | |
| 2004/0160376 | A1 * | 8/2004 | Hornsby et al. | 343/770 |
| 2004/0227669 | A1 * | 11/2004 | Okado | 343/700 MS |
| 2005/0048934 | A1 * | 3/2005 | Rawnick et al. | 455/107 |
| 2005/0146475 | A1 * | 7/2005 | Bettner et al. | 343/767 |
| 2005/0200538 | A1 * | 9/2005 | Tran | 343/702 |
| 2006/0262015 | A1 * | 11/2006 | Thornell-Pers et al. | 343/702 |
| 2008/0198082 | A1 | 8/2008 | Soler et al. | |
| 2008/0211726 | A1 * | 9/2008 | Elsallal et al. | 343/770 |
| 2009/0219215 | A1 | 9/2009 | Huber et al. | |
| 2012/0038530 | A1 * | 2/2012 | Chen et al. | 343/771 |
| 2012/0081255 | A1 | 4/2012 | Gunnels | |
| 2013/0078935 | A1 | 3/2013 | Nysen | |
| 2013/0135150 | A1 | 5/2013 | Kenoun et al. | |

OTHER PUBLICATIONS

U.S. Appl. No. 14/180,225, filed Feb. 13, 2014, Akhoondzadehasl; Lida.

* cited by examiner

*Primary Examiner* — Huedung Mancuso
(74) *Attorney, Agent, or Firm* — Linda G. Gunderson

(57) ABSTRACT

An antenna structure is disclosed that includes a dipole antenna and a slot antenna extending along a first axis. The dipole antenna and the slot antenna each have a radiation pattern that is omni-directional in an azimuth plane of the Earth. The dipole antenna radiates vertically polarized electric field, and the slot antenna radiates a horizontally polarized electric field.

34 Claims, 8 Drawing Sheets

ANTENNA STRUCTURE HAVING ORTHOGONAL POLARIZATIONS

CROSS-REFERENCE TO RELATED APPLICATIONS

This application claims the benefit under 35 USC 119(e) of the and commonly owned U.S. Provisional Application No. 61/820,073 entitled "ANTENNA STRUCTURE HAVING ORTHOGONAL POLARIZATIONS" filed on May 6, 2013, the entirety of which is incorporated by reference herein.

TECHNICAL FIELD

The present embodiments relate generally to wireless communication devices, and specifically to an antenna structure for wireless communication devices.

BACKGROUND OF RELATED ART

Some wireless communication devices, such as access points (APs) and/or mobile stations (STAB), may employ multiple-input and multiple-output (MIMO) technology to improve data throughput, to improve channel conditions, and/or to increase range. In general, MIMO may refer to the use of multiple antennas in a wireless device to achieve antenna diversity. Antenna diversity may allow the wireless device to choose to transmit and/or receive signals from a set of multiple paths through the wireless channel, which in turn may reduce the impact of multipath interference and increase channel diversity, for example, to provide well-conditioned wireless channels.

Antenna diversity may be achieved by providing polarization diversity, pattern diversity, and/or spatial diversity. Polarization diversity may be achieved by using multiple antennas with different polarizations to transmit or receive radio frequency (RF) signals. For example, a horizontally polarized antenna may be used to transmit and receive horizontally polarized signals, and a vertically polarized antenna may be used to transmit and receive vertically polarized signals. It is noted that a horizontally polarized antenna may not harvest sufficient energy from vertically polarized signals to successfully receive the vertically polarized signals, and a vertically polarized antenna may not harvest sufficient energy from horizontally polarized signals to successfully receive the horizontally polarized signals.

Pattern diversity may be achieved by using multiple antennas, each having a unique radiation pattern and/or radiation direction, to transmit or receive RF signals. More specifically, to achieve omni-directional signal transmission and reception coverage, multiple antennas may be positioned in different (e.g., orthogonal) directions so that their corresponding radiation patterns are oriented in different directions. For example, a horizontally polarized dipole antenna and a vertically polarized dipole antenna may be arranged in a "cross" configuration to provide an omni-directional radiation pattern. However, because the horizontally polarized dipole antenna may not be able to receive vertically polarized signals and the vertically polarized dipole antenna may not be able to receive horizontally polarized signals, cross-dipole antennas may not provide omni-directional signal coverage on the horizon (e.g., in the azimuth plane) for both horizontally polarized signals and vertically polarized signals. As a result, cross dipole antennas may not be suitable for use in WLAN applications (e.g., in access points and mobile stations) for which omni-directional signal coverage in the horizontal plane is desired for different polarization angles. In addition, positioning antennas in orthogonal directions may increase the space occupied by such antenna systems.

Spatial diversity may be achieved by spacing the multiple antennas apart from one another. Due to the small size and form factor of many wireless devices (e.g., APs and STAB), spatial diversity may be difficult to achieve in such wireless devices.

Thus, there is a need for a compact antenna structure that provides omni-directional coverage in the azimuth plane for signals of various polarizations.

SUMMARY

This Summary is provided to introduce in a simplified form a selection of concepts that are further described below in the Detailed Description. This Summary is not intended to identify key features or essential features of the claimed subject matter, nor is it intended to limit the scope of the claimed subject matter.

An antenna structure is disclosed that provides polarization diversity at all angles on the horizon (e.g., in the azimuth plane of the Earth) while occupying less space than conventional antenna structures having orthogonally positioned antennas (e.g., cross dipole antennas). For some embodiments, the antenna structure includes a first antenna element and a second antenna element that extend along the same axis (e.g., in a collinear and coplanar manner). The first antenna element may form a first end of a dipole antenna, and the second antenna element may form a second end of the dipole antenna and also form a slot antenna. The dipole antenna may be characterized by a first radiation pattern that is omni-directional in an azimuth plane of the Earth, and the slot antenna may be characterized by a second radiation pattern that is omni-directional in the azimuth plane. Further, the dipole antenna may radiate a vertically polarized electric field, and the slot antenna may radiate a horizontally polarized electric field. As a result, the antenna structure may provide an omni-directional radiation pattern, in the azimuth plane, that includes both horizontal polarization and vertical polarization at all angles of incidence on the horizon. In this manner, wireless devices such as APs and STAs that employ antenna structures of the present embodiments may transmit/receive both vertically polarized signals and horizontally polarized signals to/from any angle on the horizon using less antenna space than conventional antenna structures that include orthogonally positioned antenna elements.

For some embodiments, the dipole antenna is formed on a first planar conductor and a second planar conductor, and the slot antenna is formed on the second planar conductor. The first and second planar conductors may be coplanar with respect to each other. The antenna structure may include a first feed point to provide a first signal to the dipole antenna, and include second feed point to provide a second signal to the slot antenna. The first feed point may include a first positive terminal positioned on the first planar conductor, and include a first negative terminal positioned on the second planar conductor. The second feed point may include a second positive terminal positioned on the second planar conductor, and include a second negative terminal positioned on the second planar conductor. For some operations, the antenna structure may provide either the first signal to the dipole antenna or the second signal to the slot antenna. For other operations, the first and second signals may be provided to the antenna structure at the same time.

BRIEF DESCRIPTION OF THE DRAWINGS

The present embodiments are illustrated by way of example and are not intended to be limited by the figures of the accompanying drawings, where.

Like reference numerals refer to corresponding parts throughout the drawings.

DETAILED DESCRIPTION

Figure 1A:
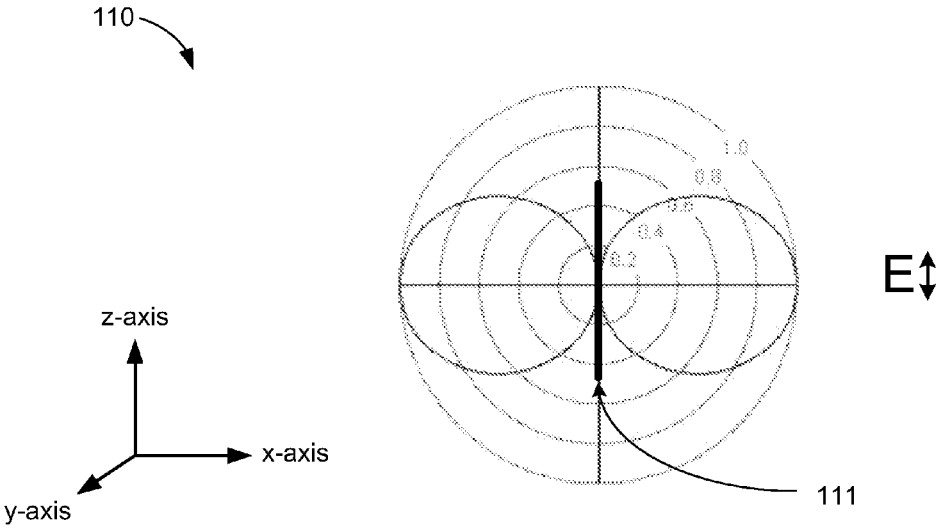
FIG. 1A depicts a radiation pattern of a vertically polarized dipole antenna.

The present embodiments are discussed below in the context of antenna structures for WLAN devices for simplicity only. It is to be understood that the present embodiments are equally applicable to other wireless communication technologies and/or standards. In the following description, numerous specific details are set forth such as examples of specific components, circuits, and processes to provide a thorough understanding of the present disclosure. The term "coupled" as used herein means connected directly to or connected through one or more intervening components or circuits. Also, in the following description and for purposes of explanation, specific nomenclature is set forth to provide a thorough understanding of the present embodiments. However, it will be apparent to one skilled in the art that these specific details may not be required to practice the present embodiments. In other instances, well-known circuits and devices are shown in block diagram form to avoid obscuring the present disclosure. The present embodiments are not to be construed as limited to specific examples described herein but rather to include within their scopes all embodiments defined by the appended claims.

The terms "horizontal plane" and "azimuth plane," as used herein, are interchangeable and refer to the two-dimensional plane parallel to the surface of the Earth (e.g., as defined by an x-axis and a y-axis). The term "vertical plane," as used herein, refers to a two-dimensional plane perpendicular to the horizontal plane (e.g., symmetrical about a z-axis).

The term "radiation pattern," as used herein, refers to a geometric representation of the relative electric field strength as emitted by a transmitting antenna at different spatial locations. For example, a radiation pattern may be represented pictorially as one or more two-dimensional cross sections of the three-dimensional radiation pattern. Because of the principle of reciprocity, it is known that an antenna has the same radiation pattern when used as a receiving antenna as it does when used as a transmitting antenna. Therefore, the term radiation pattern is understood herein to also apply to a receiving antenna, where it represents the relative amount of electromagnetic coupling between the receiving antenna and an electric field at different spatial locations.

The term "polarization," as used herein, refers to a spatial orientation of the electric field produced by a transmitting antenna, or alternatively the spatial orientation of electrical and magnetic fields causing substantially maximal resonance of a receiving antenna. For example, in the absence of reflective surfaces, a dipole antenna radiates an electric field that is oriented parallel to the radiating bodies of the antenna. The term "horizontally polarized," as used herein, refers to electromagnetic waves (e.g., RF signals) associated with an electric field (E-field) that oscillates in the horizontal direction (e.g., side-to-side in the horizontal plane), and the term "vertically polarized," as used herein, refers to electromagnetic waves (e.g., RF signals) associated with an E-field that oscillates in the vertical direction (e.g., up and down in the vertical plane).

FIG. 1A shows a cross-sectional view of a radiation pattern 110 of a vertically polarized dipole antenna 111 that extends in a vertical direction along the z-axis. The radiation pattern 110 is a toroid that is symmetrical about the z-axis and omni-directional in the horizontal plane (e.g., as defined by the x-axis and the y-axis). More specifically, the radiation pattern 110 has maximum gains in the horizontal plane and has nulls in the vertical direction extending from each end of antenna 111. As a result, antenna 111 may receive signals originating from the horizon, and may not receive signals originating from the vertical direction. Further, because antenna 111 is vertically polarized, antenna 111 may capture only the vertically polarized components of received signals. Thus, although antenna 111 has an omni-directional radiation pattern 110 in the horizontal plane, antenna 111 may not receive horizontally polarized signals originating from the horizon.

Figure 1B:
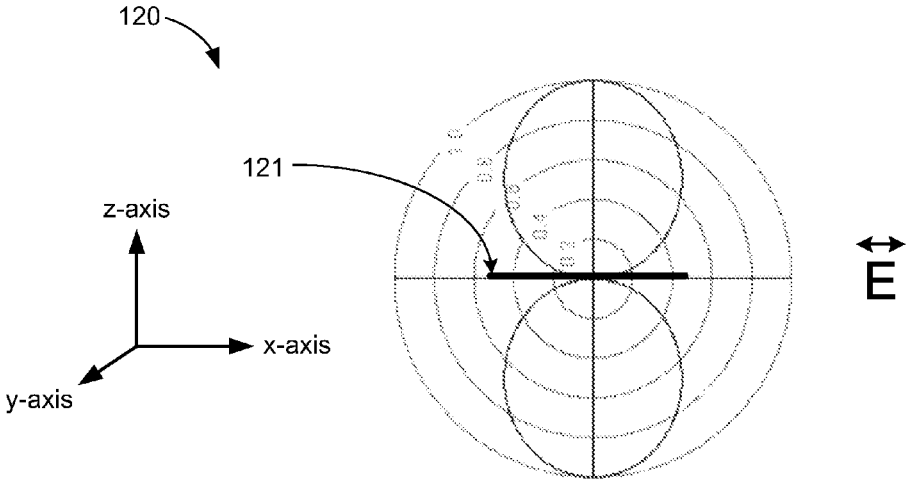
FIG. 1B depicts a radiation pattern of a horizontally polarized dipole antenna.

FIG. 1B shows a cross-sectional view of a radiation pattern 120 of a horizontally polarized dipole antenna 121 that extends in a horizontal direction (e.g., along the x-axis). The radiation pattern 120 is a toroid that is symmetrical about the x-axis and omni-directional in the vertical plane. More specifically, the radiation pattern 120 has maximum gains in the vertical plane and has nulls in the horizontal direction extending from each end of antenna 121. As a result, antenna 121 may not receive signals originating from paths on the horizon along the x-axis. Further, because antenna 121 is horizontally polarized, antenna 121 may capture only the horizontally polarized components of received signals. Thus, although antenna 121 has an omni-directional radiation pattern 120 in the vertical plane, antenna 121 may not receive vertically polarized signals.

Thus, although the vertically polarized antenna 110 and the horizontally polarized antenna 120 may be arranged together in a cross-configuration, the resulting cross dipole antenna structure may not be able to transit/receive horizontally polarized signals to/from the horizon at any angle, and may not be able to transit/receive vertically polarized signals to/from the horizon along the x-axis.

Figure 2:
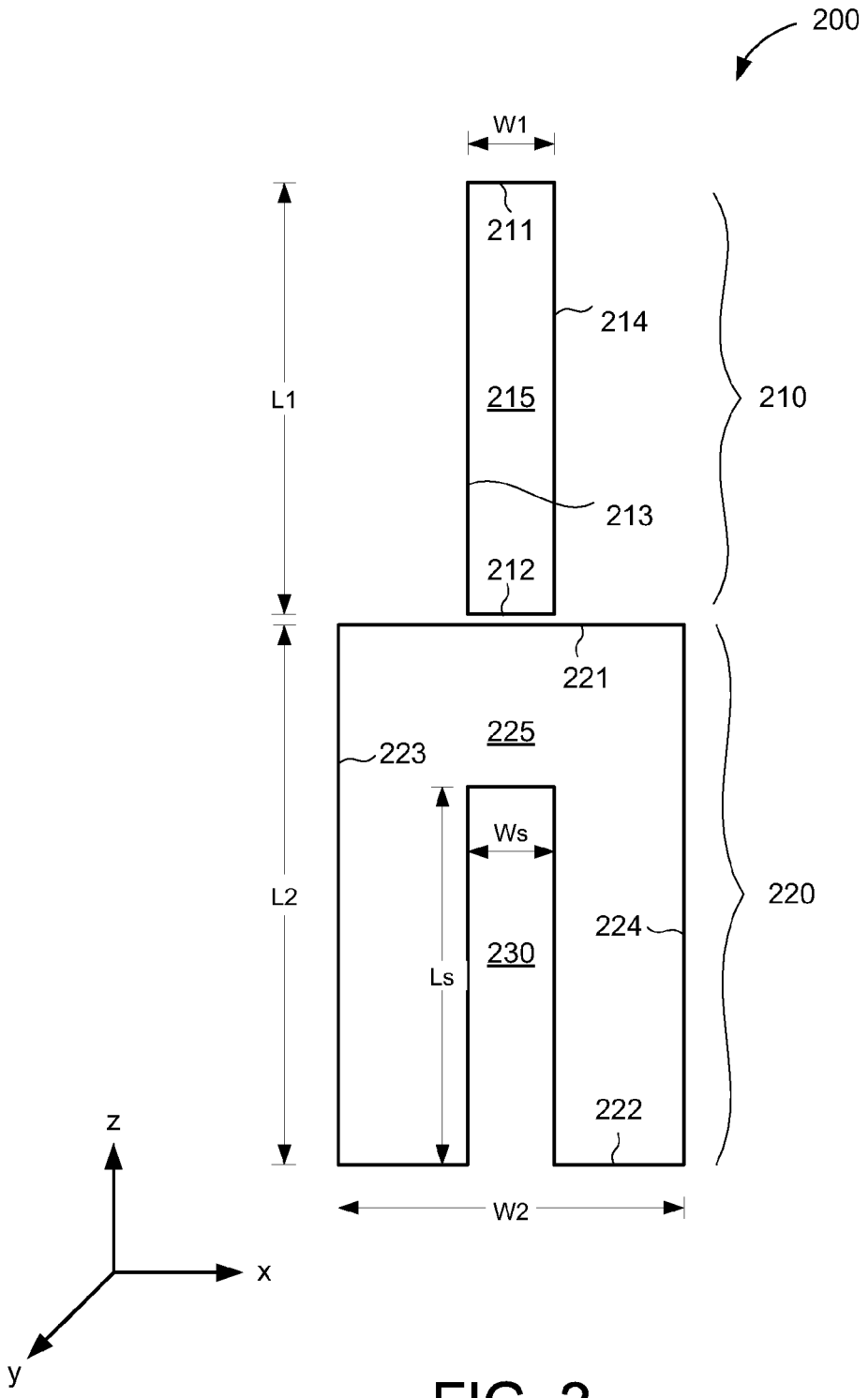
FIG. 2 shows a side plan view of an antenna structure in accordance with the present embodiments.

FIG. 2 shows an antenna structure 200 in accordance with some embodiments. The antenna structure 200, which may provide polarization diversity (e.g., for MIMO operations) at all angles on the horizon while occupying less space than conventional antenna structures having orthogonally positioned antennas (e.g., cross dipole antennas), includes a first antenna element 210 and a second antenna element 220. The first antenna element 210 and the second antenna element 220 may extend along the same axis (e.g., the z-axis as depicted in FIG. 2), and thus the first antenna element 210 and the second antenna element 220 may be collinear with each other and may be symmetrical about the same axis (e.g., the z-axis). Further, for some embodiments, the first antenna element 210 may be formed using a first planar conductor 215, and the second antenna element 220 may be formed using a second planar conductor 225. Thus, for at least some embodiments, the first antenna element 210 and the second antenna element 220 may be coplanar about the z-axis. Positioning the first antenna element 210 and the second antenna element 220 in a collinear arrangement that is symmetrical about the same axis may allow the antenna structure 200 to occupy less space than other antenna structures having orthogonally positioned antenna elements.

As depicted in FIG. 2, the first planar conductor 215 of the first antenna element 210 has a length L1 and a width W1, wherein the length L1 extends along the z-axis between a first end 211 and a second end 212 of first planar conductor 215, and the width W1 extends along the x-axis between a first side 213 and a second side 214 of first planar conductor 215. The second planar conductor 225 of the second antenna element 220 has a length L2 and a width W2, wherein the length L2 extends along the z-axis between a first end 221 and a second end 222 of second planar conductor 225, and the width W2 extends along the x-axis between a first side 223 and a second side 224 of second planar conductor 225. The second planar conductor 225 includes a slot 230 formed therein (e.g., so that the remaining portion of the second planar conductor 225 is a U-shape with the slot 230 formed opposite the first antenna element 210). The slot 230 has a length Ls extending along the z-axis and a width Ws extending along the x-axis.

The dimensions of the first antenna element 210, the dimensions of the second antenna element 220, and/or the dimensions of the slot 230 may be of any suitable values, and may be sized (e.g., with respect to an absolute scale and/or with respect to each other) to provide one or more desired antenna operating characteristics (e.g., operating frequencies, frequency responses, frequency bandwidths, antenna impedance, antenna gains, etc.). For some embodiments, the combined length of the first and second antenna elements 210 and 220 (e.g., L1+L2) may be approximately equal to one-half of the wavelength of a desired operating frequency of the antenna structure 200, and the length L2 of the second antenna element 220 may be approximately equal to one-quarter of the wavelength of the desired operating frequency of the antenna structure 200.

The first planar conductor 215 and the second planar conductor 225 may be formed using any suitable conductive material. For some embodiments, the planar conductors 215 and 225 may be formed (e.g., as traces) on a printed circuit board, although other suitable materials, surfaces, shapes, and/or techniques may be used to form the first and second antenna elements 210 and 220.

For some embodiments, the first antenna element 210 and the second antenna element 220 may be positioned adjacent to one another but not in physical contact with each other (e.g., as depicted in FIG. 2). For other embodiments, the first antenna element 210 and the second antenna element 220 may be in physical contact with each other. For at least some embodiments, the first antenna element 210 and the second antenna element 220 may be formed as a single monolithic structure (e.g., formed using a single conductor).

For some embodiments, the first antenna element 210 may operate as an electrical antenna (e.g., a monopole or dipole antenna), and the second antenna element 220 may operate as a magnetic antenna (e.g., a slot antenna or a notch antenna). For these embodiments, the first antenna element 210 may be referred to as a dipole antenna, and the second antenna element 220 may be referred to as a slot antenna.

For other embodiments, the first antenna element 210 may form a first end of the dipole antenna, and the second antenna element 220 may form a second end of the dipole antenna and also form the slot antenna (e.g., as described in more detail below with respect to FIG. 3). For these other embodiments, the first antenna element 210 and the second antenna element 220 may together be referred to as the dipole antenna, and the second antenna element 220 may be referred to individually as the slot antenna.

In accordance with the present embodiments, the antenna structure 200 may provide an omni-directional radiation pattern, in the horizontal plane, that includes both horizontal polarization and vertical polarization at all angles of incidence on the horizon. In this manner, the antenna structure 200 may be able to transmit/receive both vertically polarized signals and horizontally polarized signals to/from any direction in the horizontal plane without reduction in gain. As a result, wireless devices such as APs and STAs that employ one or more embodiments of antenna structure 200 may transmit/receive both vertically polarized signals and horizontally polarized signals to/from any angle on the horizon using less antenna space than conventional antenna structures that include orthogonally positioned antenna elements.

Figure 3:
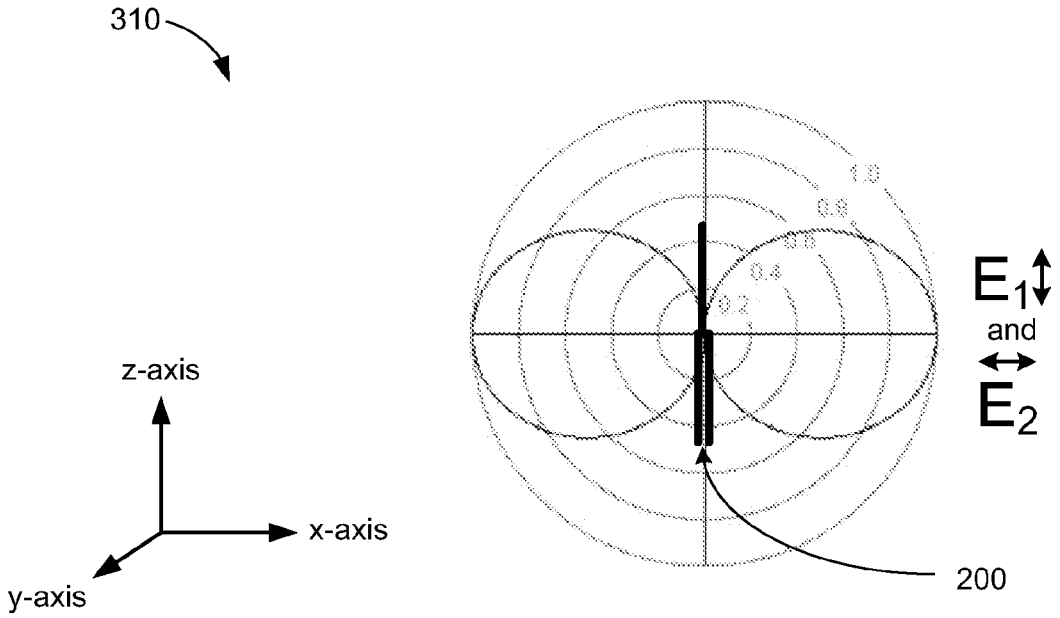
FIG. 3 depicts a radiation pattern of the antenna structure of FIG. 2.

More specifically, referring also to FIG. 3, the dipole antenna of antenna structure 200 (e.g., as formed by first antenna element 210 and second antenna element 220) is oriented in the vertical direction (e.g., along the z-axis), and radiates electrical fields (E1) that are omni-directional in the horizontal plane and have a vertical polarization. As a result, the dipole antenna of antenna structure 200 may transmit/receive vertically polarized RF signals to/from any angle in the horizontal plane. The slot antenna (e.g., as formed by second antenna element 220) is oriented in the vertical direction (e.g., along the z-axis), and radiates magnetic fields (H) that are omni-directional in the horizontal plane and have magnetic variations in the vertical direction. Because magnetic fields are orthogonal to electric fields, the slot antenna of antenna structure 200 radiates electrical fields (E2) that are omni-directional in the horizontal plane and have a horizontal polarization. Accordingly, the slot antenna of antenna structure 200 may transmit/receive horizontally polarized RF signals to/from any angle in the horizontal plane. Thus, the resulting radiation pattern 310 of antenna structure 200 is omni-directional in the horizontal plane, and includes both vertically polarized electric fields (E1) and horizontally polarized electric fields (E2). In this manner, the antenna structure 200 may exhibit omni-directional peak gains at all angles on the horizon for both vertically polarized signals and horizontally polarized signals while also providing cross pole isolation.

It is noted that, for at least some embodiments, the radiation pattern of the dipole antenna of the antenna structure 200 may be similar in direction and/or shape to the radiation pattern of the slot antenna of the antenna structure 200 (e.g., both radiation patterns are omni-directional in the horizontal plane). At least one important feature of the antenna structure 200 is that while the radiation pattern of the dipole antenna of the antenna structure 200 is vertically polarized, the radiation pattern of the slot antenna of the antenna structure 200 is horizontally polarized. Thus, by orienting the dipole antenna and the slot antenna along the same axis in the vertical direction, the resulting antenna structure 200 may provide omni-directional signal coverage in the horizontal plane for both vertically polarized signals and horizontally polarized signals.

Also note that the radiation pattern 310 of antenna structure 200 includes some nulls in the vertical directions (e.g., along the z-axis), and therefore the antenna structure 200 may exhibit reduced gains in the vertical directions (e.g., as compared to the horizontal plane).

The radiation pattern 310 of antenna structure 200, which provides both vertically polarized electric fields and horizontally polarized electric fields at all angles on the horizon, is in contrast to conventional antenna structures having an electric antenna (e.g., a dipole antenna) and a magnetic antenna (e.g., a slot antenna or loop antenna) that provide omni-directional coverage in the horizontal plane primarily for vertically polarized signals and provide omni-directional coverage in the vertical plane primarily for horizontally polarized signals. These conventional antenna structures, while providing omni-directional coverage in both the vertical plane and the horizontal plane, may not provide omni-directional coverage in the horizontal plane for both vertically polarized signals and horizontally polarized signals. As a result, such conventional antenna structures may not be suitable for use in WLAN applications (e.g., in access points and mobile stations) for which omni-directional signal coverage in the horizontal plane is desired for different polarization angles (e.g., for both vertically polarized signals and horizontally polarized signals).

Figure 4:
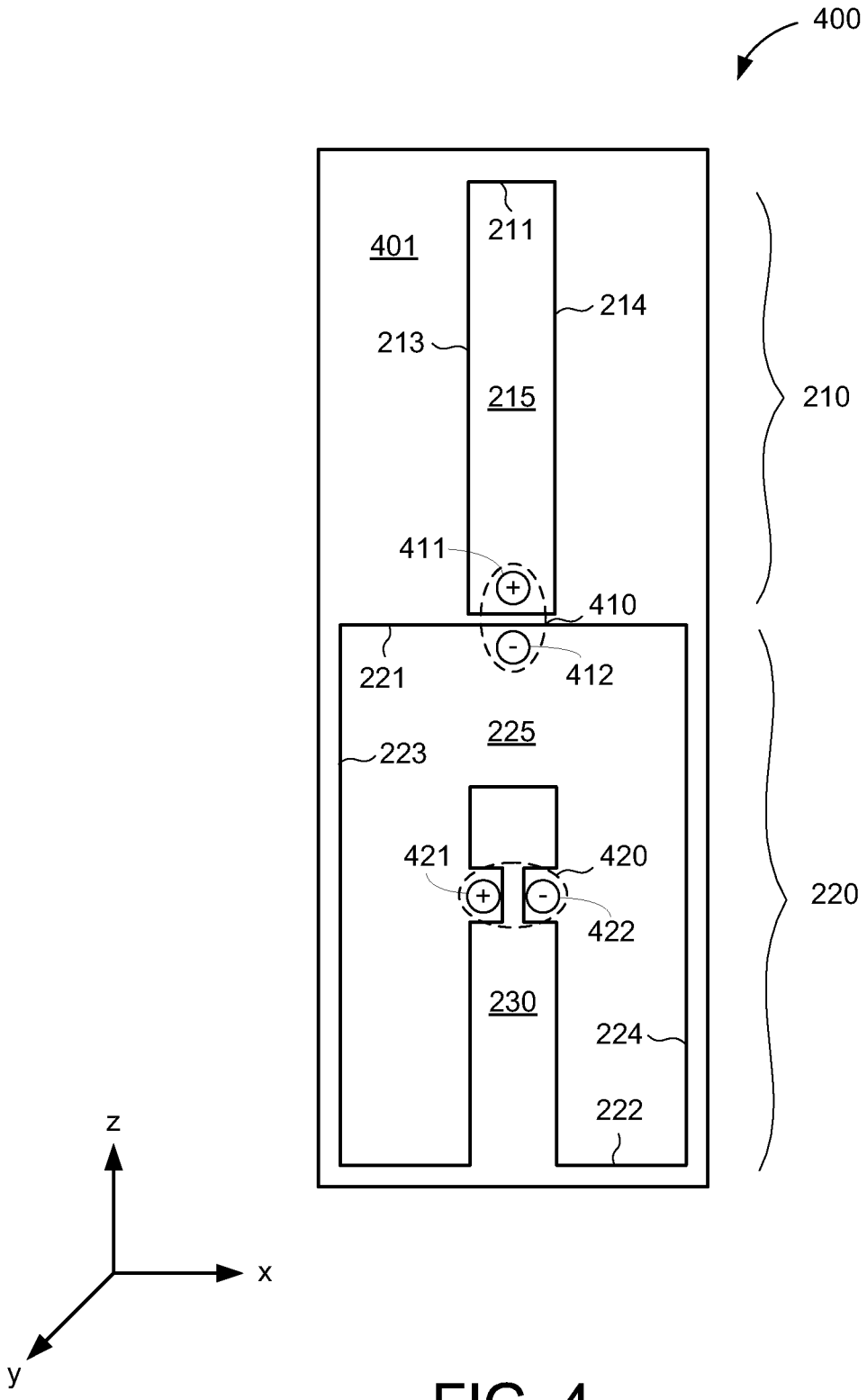
FIG. 4 shows a more detailed side plan view of the antenna structure of FIG. 2 in accordance with some embodiments.

FIG. 4 shows an antenna structure 400 that is one embodiment of antenna structure 200 of FIG. 2. The antenna structure 400 of FIG. 4 is similar to the antenna structure 200 of FIG. 2, wherein the first planar conductor 215 and the second planar conductor 225 are formed (e.g., as traces or other conductive elements) on a printed circuit board (PCB) 401. The antenna structure 400 includes a first feed point 410 and a second feed point 420. The first feed point 410, which may provide signals to and/or receive signals from the dipole antenna formed by the first antenna element 210 and the second antenna element 220, includes a positive terminal 411 and a negative terminal 412. For the exemplary embodiment shown in FIG. 4, the positive terminal 411 is positioned on the first planar conductor 215 and the negative terminal 412 is positioned on the second planar conductor 225. For other embodiments, the positive terminal 411 may be positioned on the second planar conductor 225 and the negative terminal 412 may be positioned on the first planar conductor 215. For still other embodiments, the terminals 411-412 of the first feed point 410 may both be positioned on the first planar conductor 215.

The second feed point 420, which may provide signals to and/or receive signals from the slot antenna formed by the second antenna element 220, includes a positive terminal 421 and a negative terminal 422. For the exemplary embodiment shown in FIG. 4, the positive terminal 421 is positioned on a first portion of second planar conductor 225 (e.g., to the left side of slot 230) and the negative terminal 422 is positioned on a second portion of second planar conductor 225 (e.g., to the right side of slot 230). For other embodiments, the positive terminal 421 may be positioned on the second portion of second planar conductor 225 (e.g., to the right side of slot 230) and the negative terminal 422 may be positioned on the first portion of second planar conductor 225 (e.g., to the left side of slot 230).

For the exemplary embodiment of FIG. 4, the terminals 421-422 of the second feed point 420 are positioned on portions of the second planar conductor 225 that extend into the slot 230, for example, to provide regions for connecting the terminals 421-422 to electrical lead lines or cables (not shown for simplicity). For other embodiments, the second planar conductor 225 may not include portions that extend into the slot 230 (e.g., as depicted in the exemplary embodiment of FIG. 2).

The antenna structure 400 may be coupled to a transceiver chain of a suitable wireless device (not shown for simplicity). During transmit operations of the wireless device, the transceiver chain may transmit signals from either the dipole antenna or the slot antenna of the antenna structure 400 (or both the dipole antenna and the slot antenna). For example, the transceiver chain may transmit first signals to the dipole antenna via the first feed point 410 (e.g., to transmit vertically polarized signals), and may transmit second signals to the slot antenna via the second feed point 420 (e.g., to transmit horizontally polarized signals). During receive operations of the wireless device, the transceiver chain may receive signals from either the dipole antenna or the slot antenna of the antenna structure 400 (or both the dipole antenna and the slot antenna). For example, the transceiver chain may receive first signals from the dipole antenna via the first feed point 410 (e.g., to receive vertically polarized signals), and may receive second signals from the slot antenna via the second feed point 420 (e.g., to receive horizontally polarized signals).

As an addition or an alternative, although examples described in FIGS. 2 and 4 depict antenna structure 200 and 400 being symmetric about the same axis (e.g., the z-axis), other embodiments of antenna structures 200 and/or 400 may be asymmetric about the z-axis.

Figure 5:
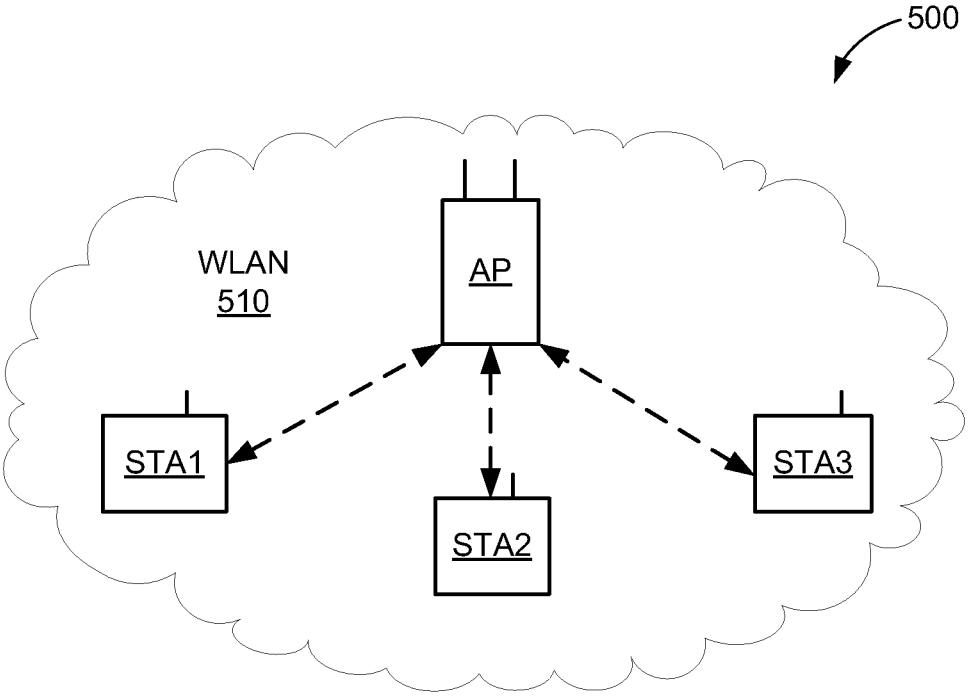
FIG. 5 shows a block diagram of a wireless network within which the present embodiments may be implemented.

As mentioned above, the antenna structures 200 and 400 of the present embodiments may be provided within wireless devices, for example, to provide MIMO functionality and/or to provide polarization diversity in all directions on the horizon. The wireless devices that employ antenna structures of the present embodiments may include wireless access points, wireless stations, and/or other wireless communication devices. For example, FIG. 5 is a block diagram of a wireless network system 500 within which the present embodiments may be implemented. The system 500 is shown to include three wireless stations (STA1, STA2, STA3), a wireless access point (AP), and a wireless local area network (WLAN) 510. In one embodiment, the WLAN 510 may be formed by a plurality of Wi-Fi access points (APs) that may operate according to various IEEE 802.11 standards (or according to other suitable wireless protocols). Although only one AP and three STAs are shown in FIG. 5 for simplicity, it is to be understood that WLAN 510 may be formed by any number of access points and/or stations.

The stations STA1-STA3 may be any suitable Wi-Fi enabled wireless devices including, for example, network-enabled sensors, memory tags (RFID tags), smart meters, cell phones, personal digital assistants (PDAs), tablet devices, laptop computers, or the like. For at least some embodiments, stations STA1-STA3 may include a transceiver circuit, one or more processing resources, one or more memory resources, and a power source (e.g., battery). The memory resources may include a non-transitory computer-readable medium (e.g., one or more nonvolatile memory elements, such as EPROM, EEPROM, Flash memory, a hard drive, etc.) that stores instructions for performing a variety of different operations.

The AP may be any suitable device that allows one or more wireless devices to connect to a network (e.g., a LAN, WAN, MAN, and/or the Internet) via the AP using Wi-Fi, Bluetooth, or any other suitable wireless communication standards. For at least one embodiment, the AP may include a transceiver circuit, one or more processing resources (e.g., a baseband processor), and one or more memory sources. The memory resources may include a non-transitory computer-readable medium (e.g., one or more nonvolatile memory elements, such as EPROM, EEPROM, Flash memory, a hard drive, etc.) that stores instructions for performing a variety of different operations.

Figure 6A:
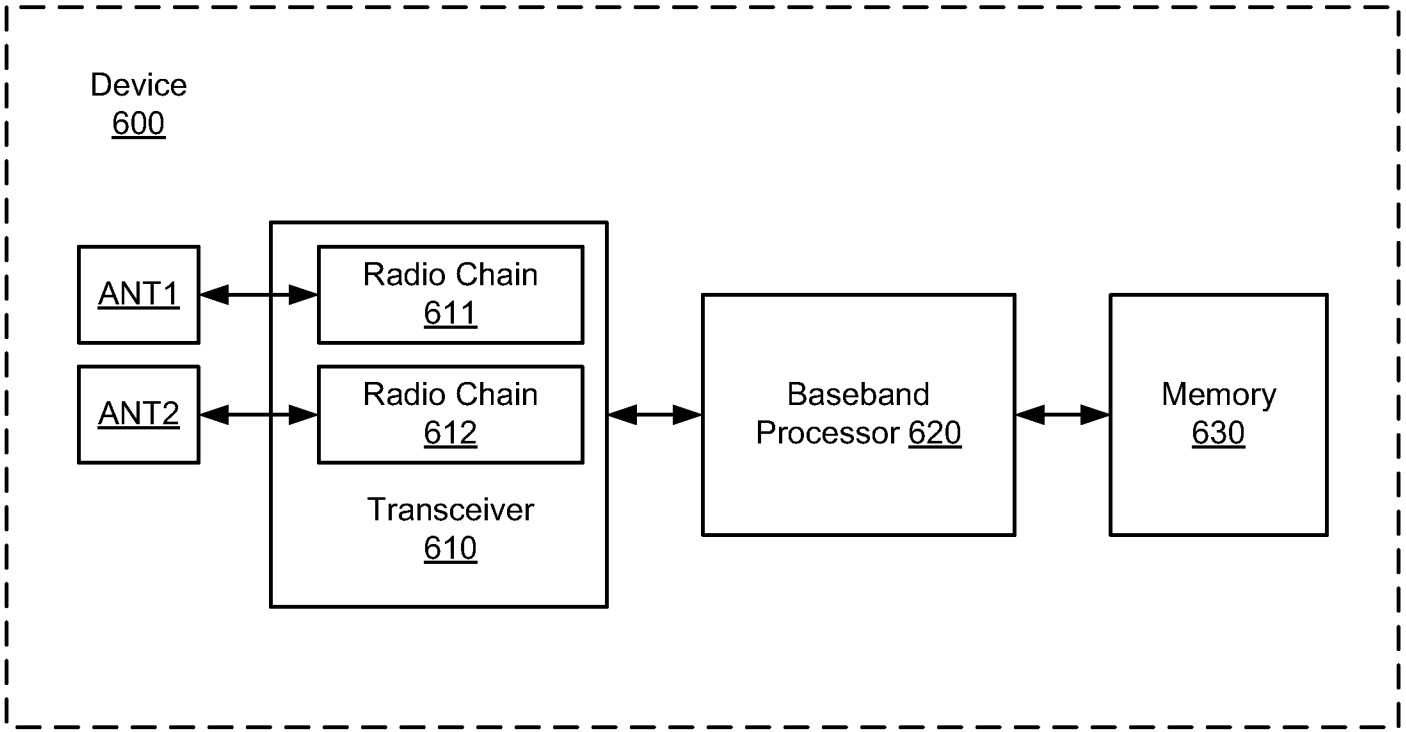
FIG. 6A shows a block diagram of a wireless device within which the present embodiments may be implemented.

FIG. 6A shows a block diagram of a wireless communication device in accordance with some embodiments. The wireless communication device 600 may include a plurality of antenna structures (ANT1-ANT2), which in turn may include antenna structures 200 and/or antenna structures 400 described above with respect to FIGS. 2-4. The device 600 includes a transceiver 610, which includes a plurality of radio chains 611 and 612, a baseband processor 620, and a memory 630. Although only two antenna structures ANT1-ANT2 are illustrated in FIG. 6A, additional antenna structures may be provided for additional radio chains, for example, so that each radio chain may be coupled to an antenna structure. Further, although only two radio chains 611 and 612 are illustrated in FIG. 6A, additional radio chains may be provided in device 600. In addition, in some examples, other components, such as a main processor, may also be included in the device 600.

The transceiver 610 may be used to communicate with other wireless communication devices or a WLAN server (not shown) associated with WLAN 510 of FIG. 5 either directly or via one or more intervening networks. The baseband processor 620, which is coupled to transceiver 610 and memory 630, may be any suitable processor capable of executing scripts or instructions of one or more software programs stored in the device 600 (e.g., within memory 630). The baseband processor 620 may manage radio functions for the device 600. Memory 630 may include a non-transitory computer-readable medium (e.g., one or more nonvolatile memory elements, such as EPROM, EEPROM, Flash memory, a hard drive, etc.) that may store instructions executed by the baseband processor 620.

Each of radio chains 611 and 612 of the transceiver 610 may be coupled to an antenna structure (e.g., antenna structure 200 or antenna structure 400). For some embodiments, the transceiver 610 may select (e.g., via a switch and other circuitry) either the dipole antenna or the slot antenna of the corresponding antenna structure 200/400 for transmission or reception of RF signals. For other embodiments, the transceiver 610 may transmit/receive the same signals to/from both the dipole antenna and the slot antenna of the corresponding antenna structure 200/400 for transmission or reception of RF signals. Because the dipole antenna and the slot antenna of each antenna structure 200/400 provide vertical polarization and horizontal polarization, respectively, for all angles in the horizontal plane, full polarization diversity may be achieved for MIMO performance in the device 600.

Figure 6B:
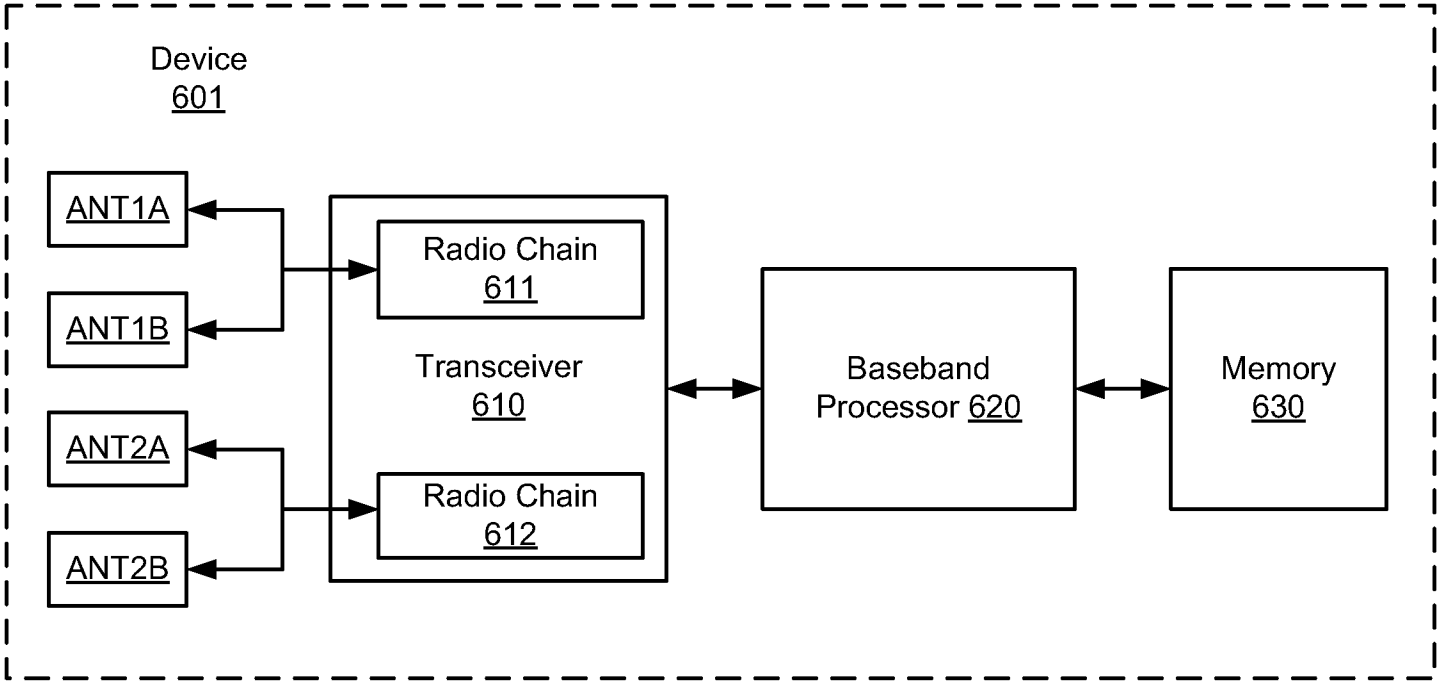
FIG. 6B shows a block diagram of another wireless device within which the present embodiments may be implemented.

FIG. 6B shows a block diagram of a wireless communication device in accordance with other embodiments. The wireless communication device 601 may include all the elements of device 600 of FIG. 6A, plus two additional antenna structures. More specifically, for the exemplary device 601 of FIG. 6B, radio chain 611 is coupled to two antenna structures ANT1A and ANT1B, and radio chain 612 is coupled to two antenna structures ANT2A and ANT2B. The antenna structures ANT1A, ANT1B, ANT2A, and ANT2B may include antenna structures 200 and/or antenna structures 400 described above with respect to FIGS. 2-4. Providing two antenna structures for each of radio chains 611 and 612 may increase antenna diversity for device 601 (e.g., as compared with device 600 of FIG. 6A).

Figure 7:
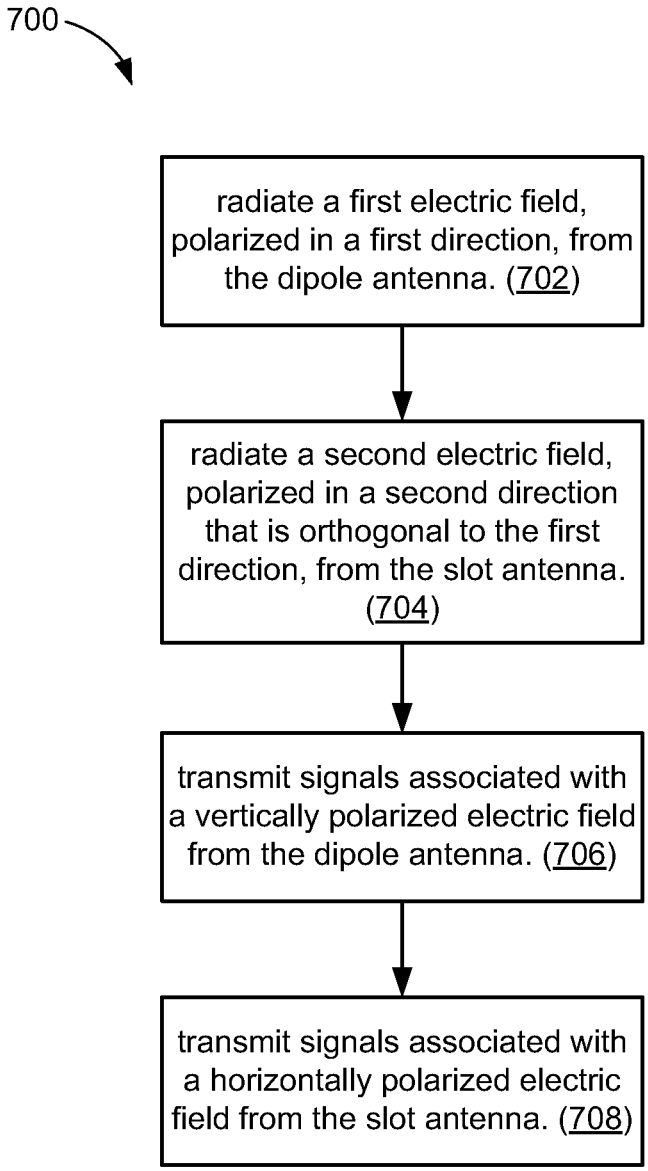
FIG. 7 is a flow chart depicting an exemplary operation of an antenna structure in accordance with some embodiments.

FIG. 7 is an illustrative flow chart 700 that depicts an exemplary operation performed using one or more of antenna structures 200 and/or 400 in accordance with some embodiments. Although the operation of flow chart 700 is described below with respect to FIG. 2 for simplicity, the operation of flow chart 700 may also be applicable to embodiments of FIG. 4. To transmit a signal from a device (e.g., device 600 and/or 601) using antenna structure 200, the dipole antenna radiates a first electric field that is polarized in a first direction (702), and the slot antenna radiates a second electric field that is polarized in a second direction that is orthogonal to the first direction (704). As mentioned above, for some embodiments, the dipole antenna and the slot antenna extend along and are collinear with a first axis, wherein the first axis is oriented in a vertical direction that is perpendicular to an azimuth plane of the Earth. Thereafter, the dipole antenna may transmit signals associated with a vertically polarized electric field (706), and the slot antenna may transmit signals associated with a horizontally polarized electric field (708). Further, as described above, the dipole antenna may be characterized by a first radiation pattern that is omni-directional in an azimuth plane of the Earth, and the slot antenna may be characterized by a second radiation pattern that is omni-directional in the azimuth plane.

In the foregoing specification, the present embodiments have been described with reference to specific exemplary embodiments thereof. It will, however, be evident that various modifications and changes may be made thereto without departing from the broader scope of the disclosure as set forth in the appended claims. The specification and drawings are, accordingly, to be regarded in an illustrative sense rather than a restrictive sense.

What is claimed is:

1. An antenna structure, comprising:

a dipole antenna extending along a first axis, the dipole antenna comprising a first planar conductor and a second planar conductor; and a slot antenna extending along the first axis, the slot antenna comprising the second planar conductor, wherein the dipole antenna is to radiate a first electric field polarized in a first direction, and the slot antenna is to radiate a second electric field polarized in a second direction that is orthogonal to the first direction.

2. The antenna structure of claim 1, wherein the dipole antenna and the slot antenna are coplanar.

3. The antenna structure of claim 1, wherein the dipole antenna and the slot antenna are symmetrical about the first axis.

4. The antenna structure of claim 1, wherein the dipole antenna comprises an electrical antenna, and the slot antenna comprises a magnetic antenna.

5. The antenna structure of claim 1, wherein the slot antenna comprises a portion of the dipole antenna.

6. The antenna structure of claim 1, wherein the first axis is oriented in a vertical direction that is perpendicular to an azimuth plane of the Earth, and wherein:

the dipole antenna is to transmit signals associated with a vertically polarized electric field; and the slot antenna is to transmit signals associated with a horizontally polarized electric field.

7. The antenna structure of claim 1, wherein:

the dipole antenna is characterized by a first radiation pattern that is omni-directional in an azimuth plane of the Earth; and the slot antenna is characterized by a second radiation pattern that is omni-directional in the azimuth plane.

8. The antenna structure of claim 1, wherein the first axis is oriented in a vertical direction that is perpendicular to an azimuth plane of the Earth, and wherein:

the dipole antenna is to receive signals associated with a vertically polarized electric field; and the slot antenna is to receive signals associated with a horizontally polarized electric field.

9. The antenna structure of claim 1, wherein:

the dipole antenna and the slot antenna each have a radiation pattern that is omni-directional in an azimuth plane of the Earth; and the dipole antenna and the slot antenna radiate electric fields having orthogonal polarizations.

10. The antenna structure of claim 1, wherein the dipole antenna has a first length that is approximately one-half of a wavelength of an operating frequency of a signal, and the slot antenna has a second length that is approximately one-quarter of the wavelength.

11. The antenna structure of claim 1, further comprising:

a first feed point to provide a first signal to the dipole antenna, wherein the first feed point comprises:

a first positive terminal positioned on the first planar conductor; and a first negative terminal positioned on the second planar conductor; and a second feed point to provide a second signal to the slot antenna, wherein the second feed point comprises:

a second positive terminal positioned on the second planar conductor; and a second negative terminal positioned on the second planar conductor.

12. An antenna structure, comprising:

a first element extending along a first axis, the first element comprising a first planar conductor and a second planar conductor; and a second element, coupled to the first element, extending along the first axis, the second element comprising the second planar conductor, wherein:

the first element forms a first end of a dipole antenna; and the second element forms a second end of the dipole antenna and forms a slot antenna.

13. The antenna structure of claim 12, wherein the dipole antenna and the slot antenna are symmetrical about the first axis.

14. The antenna structure of claim 12, wherein:

the dipole antenna is characterized by a first radiation pattern that is omni-directional in an azimuth plane of the Earth; and the slot antenna is characterized by a second radiation pattern that is omni-directional in the azimuth plane.

15. The antenna structure of claim 12, wherein the first axis is oriented in a vertical direction that is perpendicular to an azimuth plane of the Earth, and wherein:

the dipole antenna is to radiate a vertically polarized electric field; and the slot antenna is to radiate a horizontally polarized electric field.

16. The antenna structure of claim 12, wherein the second planar conductor is co-planar with the first planar conductor.

17. The antenna structure of claim 12, further comprising:

a first feed point to provide a first signal to the dipole antenna, wherein the first feed point comprises:

a first positive terminal positioned on the first planar conductor; and a first negative terminal positioned on the second planar conductor; and a second feed point to provide a second signal to the slot antenna, wherein the second feed point comprises:

a second positive terminal positioned on the second planar conductor; and a second negative terminal positioned on the second planar conductor.

18. The antenna structure of claim 12, wherein the dipole antenna has a first length that is approximately one-half of a wavelength of an operating frequency of a signal, and the slot antenna has a second length that is approximately one-quarter of the wavelength.

19. The antenna structure of claim 12, wherein:

the dipole antenna and the slot antenna each have a radiation pattern that is omni-directional in an azimuth plane of the Earth; and the dipole antenna and the slot antenna radiate electric fields having orthogonal polarizations.

20. A method of operating a communication device including an antenna structure that includes a dipole antenna having a first planar conductor and a second planar conductor and a slot antenna that includes the second planar conductor, extending along a first axis, the method comprising:

radiating a first electric field, polarized in a first direction, from the slot antenna; and radiating a second electric field, polarized in a second direction that is orthogonal to the first direction, from the slot antenna.

21. The method of claim 20, wherein the dipole antenna and the slot antenna are coplanar and are symmetrical about the first axis.

22. The method of claim 20, wherein the first axis is oriented in a vertical direction that is perpendicular to an azimuth plane of the Earth, the method further comprising:

transmitting signals associated with a vertically polarized electric field from the dipole antenna; and transmitting signals associated with a horizontally polarized electric field from the slot antenna.

23. The method of claim 20, wherein:

the dipole antenna is characterized by a first radiation pattern that is omni-directional in an azimuth plane of the Earth; and the slot antenna is characterized by a second radiation pattern that is omni-directional in the azimuth plane.

24. A communication device, comprising:

a radio chain; and an antenna structure coupled to the radio chain, the antenna structure comprising:

a dipole antenna comprising a first planar conductor and a second planar conductor, the dipole antenna extending along a first axis; and a slot antenna comprising the second planar conductor, the slot antenna extending along the first axis, wherein the dipole antenna is to radiate a first electric field polarized in a first direction, and the slot antenna is to radiate a second electric field polarized in a second direction that is orthogonal to the first direction.

25. The communication device of claim 24, wherein the dipole antenna and the slot antenna are coplanar.

26. The communication device of claim 24, wherein the dipole antenna and the slot antenna are symmetrical about the first axis.

27. The communication device of claim 24, wherein the dipole antenna comprises an electrical antenna, and the slot antenna comprises a magnetic antenna.

28. The communication device of claim 24, wherein the slot antenna comprises a portion of the dipole antenna.

29. The communication device of claim 24, wherein the first axis is oriented in a vertical direction that is perpendicular to an azimuth plane of the Earth, and wherein:

the dipole antenna is to transmit signals associated with a vertically polarized electric field; and the slot antenna is to transmit signals associated with a horizontally polarized electric field.

30. The communication device of claim 24, wherein:

the dipole antenna is characterized by a first radiation pattern that is omni-directional in an azimuth plane of the Earth; and the slot antenna is characterized by a second radiation pattern that is omni-directional in the azimuth plane.

31. The communication device of claim 24, wherein the first axis is oriented in a vertical direction that is perpendicular to an azimuth plane of the Earth, and wherein:

the dipole antenna is to receive signals associated with a vertically polarized electric field; and the slot antenna is to receive signals associated with a horizontally polarized electric field.

32. The communication device of claim 24, wherein:

the dipole antenna and the slot antenna each have a radiation pattern that is omni-directional in an azimuth plane of the Earth; and the dipole antenna and the slot antenna radiate electric fields having orthogonal polarizations.

33. The communication device of claim 24, wherein the dipole antenna has a first length that is approximately one-half of a wavelength of an operating frequency of a signal, and the slot antenna has a second length that is approximately one-quarter of the wavelength.

34. The communication device of claim 24, wherein the antenna structure further comprises:

a first feed point to provide a first signal to the dipole antenna, wherein the first feed point comprises:

a first positive terminal positioned on the first planar conductor; and a first negative terminal positioned on the second planar conductor; and a second feed point to provide a second signal to the slot antenna, wherein the second feed point comprises:

a second positive terminal positioned on the second planar conductor; and a second negative terminal positioned on the second planar conductor.

* * * * *